US007019272B2

(12) United States Patent
Braunisch et al.

(10) Patent No.: US 7,019,272 B2
(45) Date of Patent: Mar. 28, 2006

(54) WALL MOUNTED MICROWAVE OVEN HAVING AN EXHAUST VENTILATION SYSTEM

(75) Inventors: Eckart Wilhelm Braunisch, Kimstad (SE); Per Törngren, Norrköping (SE); Hans Lundstrom, Rejmyre (SE); Hans Lindgren, Norrköping (SE); Hakan Carlsson, Norrköping (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/882,958

(22) Filed: Jul. 1, 2004

(65) Prior Publication Data

US 2006/0011621 A1 Jan. 19, 2006

(51) Int. Cl.
*H05B 6/80* (2006.01)

(52) U.S. Cl. ..... 219/757; 219/681; 126/21 A; 126/299 R

(58) Field of Classification Search ..... 219/756–757, 219/681, 400; 126/21 A, 299 R, 21 R, 299 D
See application file for complete search history.

(56) References Cited

U.S. PATENT DOCUMENTS

| | | | | |
|---|---|---|---|---|
| 4,107,502 | A * | 8/1978 | Tanaka et al. | 219/754 |
| 4,143,646 | A * | 3/1979 | Sampsel | 125/299 D |
| 4,235,220 | A * | 11/1980 | Hepner | 126/299 D |
| 4,327,274 | A | 4/1982 | White et al. | 219/10.55 |
| 5,886,330 | A * | 3/1999 | Kang et al. | 219/757 |
| 6,396,037 | B1 * | 5/2002 | Rossouw et al. | 219/746 |
| 6,433,324 | B1 | 8/2002 | Kim | 219/757 |
| 6,538,774 | B1 | 3/2003 | Weidlich | 358/3.29 |
| 2003/0218011 | A1 | 11/2003 | Jeong | 219/757 |
| 2004/0000547 | A1 | 1/2004 | Kim | 219/757 |

FOREIGN PATENT DOCUMENTS

| | | | | |
|---|---|---|---|---|
| JP | 1-184332 | * | 7/1989 | 219/756 |
| JP | 2-78184 | * | 3/1990 | 219/757 |

* cited by examiner

*Primary Examiner*—Philip H. Leung
(74) *Attorney, Agent, or Firm*—John F. Colligan; Robert O. Rice; Stephen Krefman

(57) ABSTRACT

A wall mounted type microwave oven having an external enclosure including a bottom closure wall which includes a suction opening and a top vent opening and an oven cavity which is supported within the external enclosure. The oven cavity has a rearwardly stepped portion to maximize the usable space provided within the oven cavity. An air exhaust air path is formed between the external enclosure and the oven cavity and includes a bottom plenum, a pair of rear air channels and an upper plenum. The rearwardly stepped area divides the space between the oven cavity and the external enclosure into the two rear air channels. At least one blower is provided within the external enclosure for drawing air into the bottom plenum through the suction opening and exhausting the air out through a top exhaust opening which forms part of the top vent opening. By providing the air exhaust path along the bottom plenum, the two rear air channels and the upper plenum and by having the air exhaust path not occupy any space along the sides of the oven cavity, a maximum oven cavity width is achieved. By directing the exhaust air stream through the two rear air channels maximizes at the same time the usable space within the oven cavity.

14 Claims, 4 Drawing Sheets

WALL MOUNTED MICROWAVE OVEN HAVING AN EXHAUST VENTILATION SYSTEM

The present invention relates to a microwave oven, and more particularly to an exhaust ventilation system for a microwave oven configured to be mounted above an oven range.

BACKGROUND OF THE INVENTION

Conventional microwave ovens are generally classified into several different types including: tabletop microwave ovens designed to be seated on a table and/or countertop; and a ventilation hood-combined microwave oven designed to be mounted above a oven range—sometimes referred to as Over-The-Range (OTR) microwaves. An OTR microwave includes a ventilation hood type system for exhausting hot air, steam, smoke, etc. generated from the oven range. The ventilation system for a typical OTR microwave normally includes a suction opening, which is frequently provided with a grease/smoke filter, located along the bottom surface of the OTR microwave. Exhaust air flow is drawn into the suction opening and is passed around the microwave oven cavity and is directed either back into the kitchen environment through an exhaust outlet opening or is directed to an external exhaust.

U.S. Pat. No. 6,433,324 discloses an exhaust flow passage system for an OTR microwave oven having an oven cavity surrounded by a outer case. In the background of this patent, various prior art systems are discussed for providing airflow passages along both sides of the microwave oven cavity and the outer case. This patent further describes and claims an OTR microwave oven having an exhaust airflow passage provided solely along one side of the oven cavity—between the oven cavity and outer case—opposite an electric equipment installation chamber.

U.S. Pat. No. 4,327,274 also discloses an OTR microwave having a bottom vent openings provided with air intake filters wherein a blower draws exhaust air in through the vent openings and directs the exhaust air through a passage between the back wall of the microwave cavity and a rear cabinet wall. The exhaust air then exits the microwave assembly through either a top or rear outlet opening, depending on the installation configuration.

U.S. Patent Application 2003/0218011 A1 discloses a wall mounted microwave oven having an exhaust fan assembly which increases an internal cooking chamber volume. This is accomplished through a fan assembly system mounted along the upper, rear corner of the microwave and which protrudes upwardly from the oven body.

SUMMARY OF THE INVENTION

The present invention is directed to a wall mounted type microwave oven having an external enclosure including a bottom closure wall which includes a suction opening and a top vent opening and an oven cavity which is supported within the external enclosure. The oven cavity has a rearwardly stepped portion to maximize the usable space provided within the oven cavity. An air exhaust air path is formed between the external enclosure and the oven cavity and includes a bottom plenum, a pair of rear air channels and an upper plenum. At least one blower is provided within the external enclosure for drawing air into the bottom plenum through the suction opening and exhausting the air out through a top exhaust opening which forms part of the top vent opening. The rearwardly stepped area divides the space between the oven cavity and the external enclosure into the two rear air channels which receive an exhaust air stream from the blower.

The invention may include at least one filter cover provided over top vent opening. The filter cover preferably has a frame supporting a filter mesh interior. The filter cover can be removably fitted within a depressed region provided about the top vent area such that the filter cover is positioned below a top surface of the enclosure. A plurality of louvers are provide across the top vent opening below the filter cover for supporting the filter cover and directing air flow.

The microwave oven of the invention may further include a side compartment formed between the side wall of the external enclosure and the side wall of the oven cavity. The side compartment is isolated from the air exhaust path such that the exhaust air stream does not communicate with the side compartment. An electrical equipment chamber is set within the side compartment. A cooling blower mounted within the side compartment for drawing air into the side compartment through the top inlet opening which forms part of the top vent opening. By providing the air exhaust path along the bottom plenum, the two rear air channels and the upper plenum and by having the air exhaust path not occupy any space along the sides of the oven cavity a maximum oven cavity width is achieved.

BRIEF DESCRIPTION OF THE DRAWINGS

The present invention will be more apparent from the accompanying drawings, which are provided by way of non-limiting example and in which.

DETAILED DESCRIPTION OF THE PREFERRED EMBODIMENTS

Figure 1:
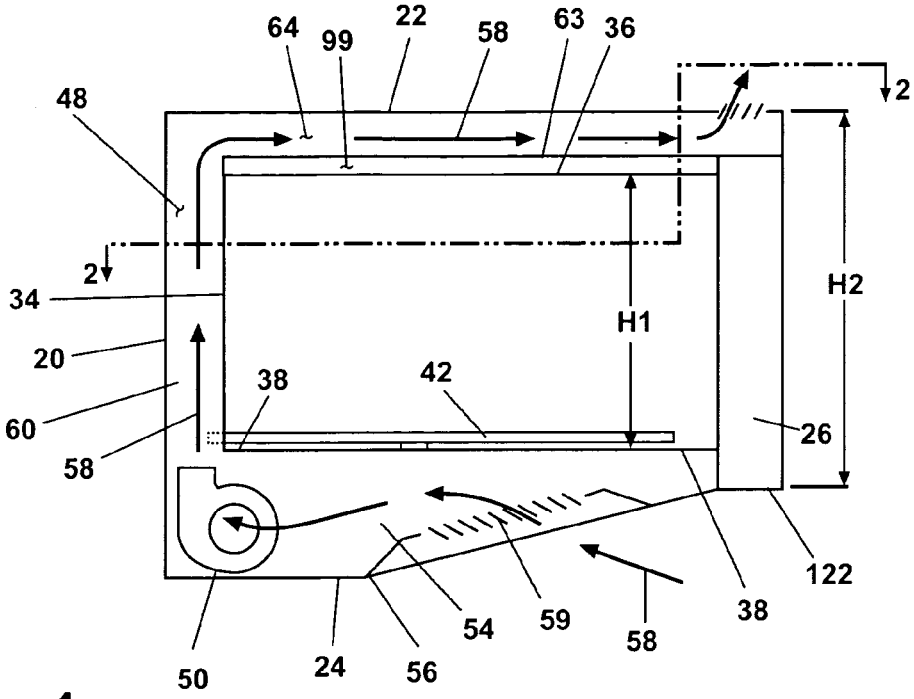
FIG. 1 is a side cross-sectional view of a microwave oven embodying the principles of the present invention.

Referring to the drawings, there is shown a ventilation hood-combined microwave oven 10 designed to be mounted to a wall above an oven range, sometimes referred to as an Over-The-Range (OTR) microwave or wall mounted type microwave, in accordance with the present invention.

Figure 2:
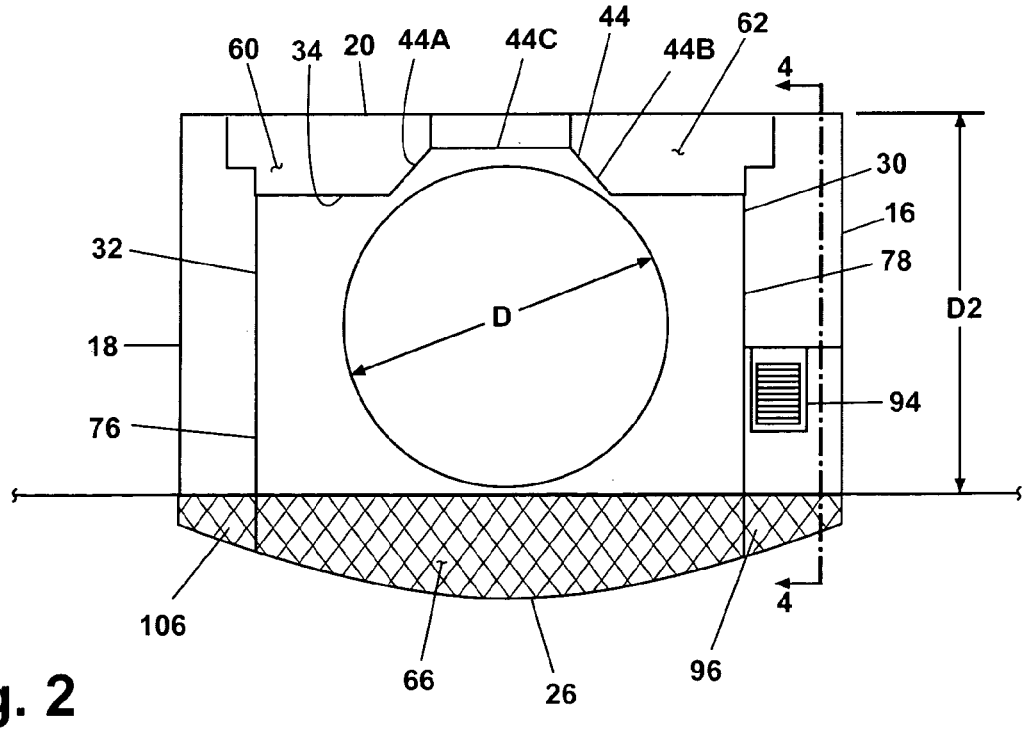
FIG. 2 is a top cross-sectional view taken along line II—II of FIG. 1.

Looking at FIGS. 1 and 2, it can be seen that the microwave oven 10 includes an oven cavity 12 which is provided within an exterior enclosure or outer case 14. The enclosure 14 includes side walls 16, 18, rear wall 20, a top wall 22 and a bottom closure wall 24. The front face or surface of the enclosure 14 is formed by a pivotable door 26 which may have a curved or bowed out shape.

The oven cavity 12 includes side walls 30 and 32, rear wall 34, a top wall 36 and a bottom wall 38. The cavity 12 is provided with a front access opening closable through operation of the pivotable door 26. Preferably, the height of the oven cavity (H) is maximized within a predetermined or predefined overall height of the enclosure (H2). The door 26 forms a front surface of the microwave and may extend along the full height (H2) of the enclosure. Rotatably supported within the oven cavity along the bottom wall 38 is a turn table plate 42.

The oven cavity 12 is designed to maximize the cooking volume within a fixed or predetermined total overall size of the microwave oven 10. It is desirable to have the diameter (D) of the plate a maximum size while at the same time minimizing the overall depth (D2). In order to accomplish this objective, the rear wall 34 of the oven cavity 12 has a rearwardly stepped portion 44 which includes two angled wall sections 44*a* and 44*b* and a center section 44*c*. This rearwardly stepped portion 44 extends toward and approaches the rear wall 20. The plate 42 is rotatably supported so that it partially extends into the rearwardly stepped portion 44.

An exhaust ventilation system is also provided as part of the microwave oven 10. The exhaust ventilation system includes an air exhaust path, generally referred to at 48, which includes a bottom plenum 54, rear air channels 60 and 62, and an upper air plenum 64, as described hereinbelow. A pair of blowers 50 and 52 are located along the rear portion of the air plenum or space 54 which is formed between the bottom closure wall 24 of the enclosure 14 and the bottom wall 38 of the microwave oven cavity 12. The bottom closure wall 24 extends horizontally forward from its connection with the rear wall 20 to a crease or bend line 56 to provide an enlarged space along a rear portion thereof for locating the blowers 50 and 52. The blowers 50 and 52 include blower wheels 50*a* and 50*b* that have their longitudinal axis extending parallel to the plane occupied by the rear wall 34 and bottom wall 38 of the oven cavity 12. The blower wheels 50*a* and 52*a*, in turn, are carried within an air channeling housings 50*b* and 52*b*. While two blowers 50 and 52 are shown, it can be appreciated that only a single blower could also be used, or a pair of blower wheels driven by a single motor.

The blowers 50 and 52 operate to draw air into the blower wheels 50*a* and 52*a* in one direction and to direct the same air away from the wheels in a direction approximately 90 degrees displaced from the direction of flow of the entering air. By positioning the relatively large diameter blower wheels 50*a* and 52*a* in the enlarged rear portion of the plenum 54, the bottom closure wall 24 is permitted to slope upwardly toward the front. In this way, greater visibility of the space underneath the microwave oven 10 is provided. Moreover, by locating the blowers 50 and 52 in the preferred lower rear corner position as shown, an intake air stream 58 is created which takes a right angle turn in the air exhaust path through the blower wheels 50*a* and 52*a*. Changing the direction of an air stream flow results in a air flow resistance or efficiency loss. By locating the blower wheels 50*a* and 52*a* at the 90 degree bend in the path of the air stream 58, the efficiency of the exhaust ventilation system is increased.

Air is drawn or sucked into the exhaust ventilation system by the blowers 50 and 52 through a suction grill or opening 59. The suction opening 59 is provided in the bottom closure wall 24. A filter (not shown) may be provided adjacent the suction opening 59 for filtering air as it passes into the air exhaust path 48. After the air stream 58 passes through the blowers 50 and 52, the air stream is divided between two upwardly directed rear air channels 60 and 62 defined between the rear wall 20 of the enclosure 14 and the rear wall 34 of the oven cavity 12. The two rear air channels 60 and 62 are separated by the rearwardly stepped portion 44 which approaches the rear wall 20. The distance between the rear center section 44*c* and the rear wall 20 may be sufficient to allow for the provision of insulation along the surface of the rear wall 20. Or alternatively, the center section 44*c* may approach the rear wall 20 to the point of contact. Further, the air exhaust path may utilize only one of the rear air channels.

Figure 3A:
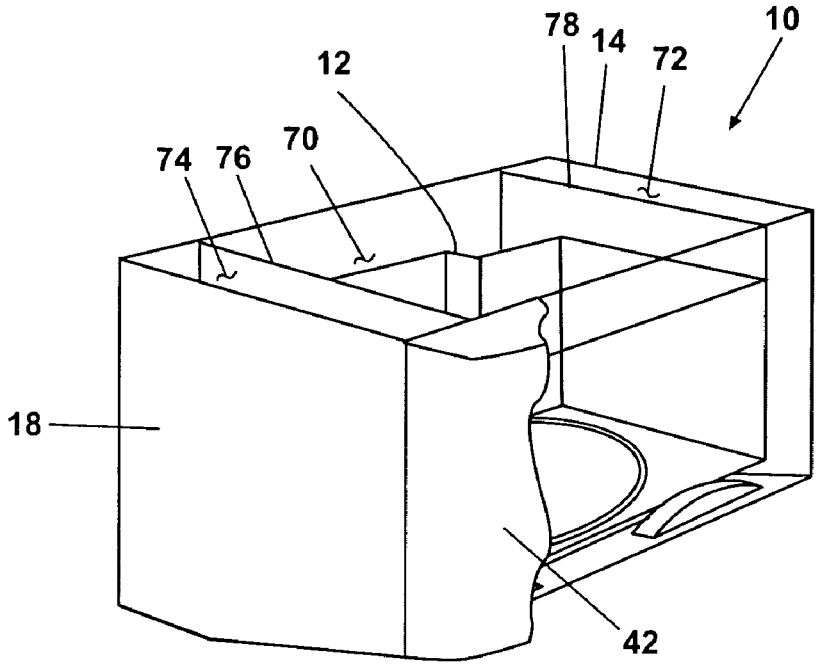
FIG. 3A is a perspective view of the microwave oven of FIG. 1, with portions of the door cut away to reveal internal structures.
Figure 3B:
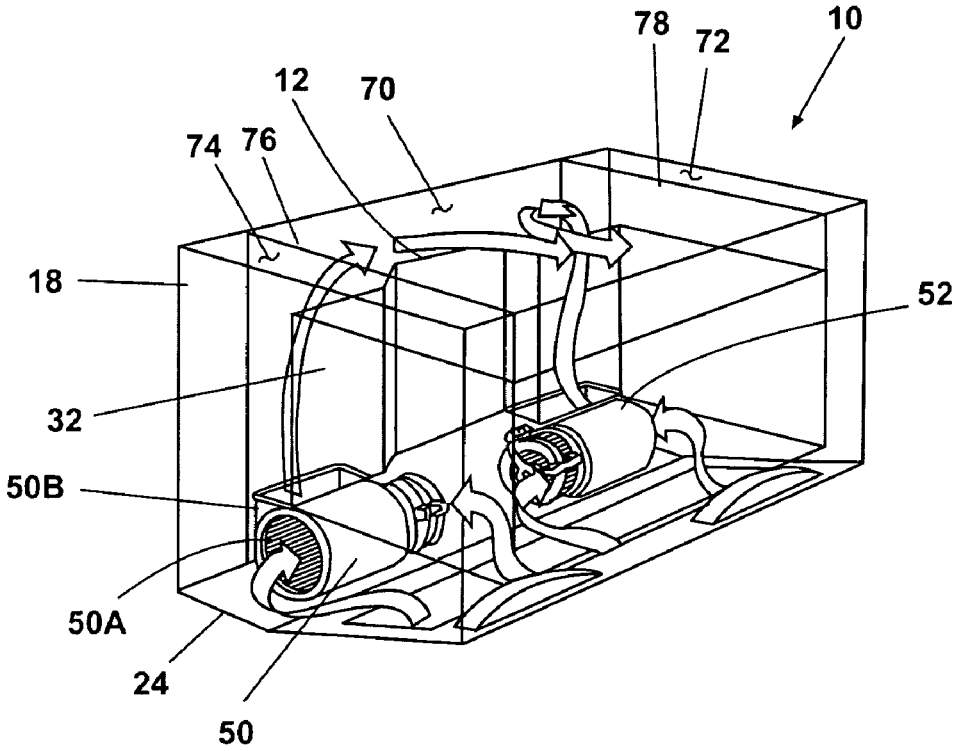
FIG. 3B is a perspective view of the microwave oven of FIG. 1, with the door removed and most wall sections being shown only in outline to allow for illustration of the air flow within the air exhaust path.

As seen in FIG. 1 and FIGS. 3A and 3B, once the air streams 58 reaches the top of the air channels 60 and 62, the air streams are again joined into a single air stream which is then directed around a 90 degree bend in the path of the air stream and flows toward the front face of the enclosure 14. The air stream moves forwardly along the wall 63 of the oven cavity 12 through a upper air plenum or space 64 toward a top exhaust opening 66. After reaching the top exhaust opening 66, the air stream is vented upwardly into the ambient environment. There may also be provisions to direct the air stream to an external vent (not shown) such that the air stream is directed upwardly or rearwardly from the back rear corner.

The enclosure 14 of the microwave 10 is effectively divided into three basic compartments, as best seen in FIG. 3. A center compartment 70 is provided along with a first side compartment 72 and a second side compartment 74. The oven cavity 12 and exhaust ventilation system discussed above are located within the center compartment 70. Divider walls 76 and 78 extend upward to the top wall 22 to completely seal the center compartment 70 from the side compartments 72 and 74. The divider walls 76 and 78 may be extensions of the side walls 30 and 32 of the oven cavity 12. In this way, air streams passing through the exhaust ventilation system do not enter into the side compartments.

Figure 4:
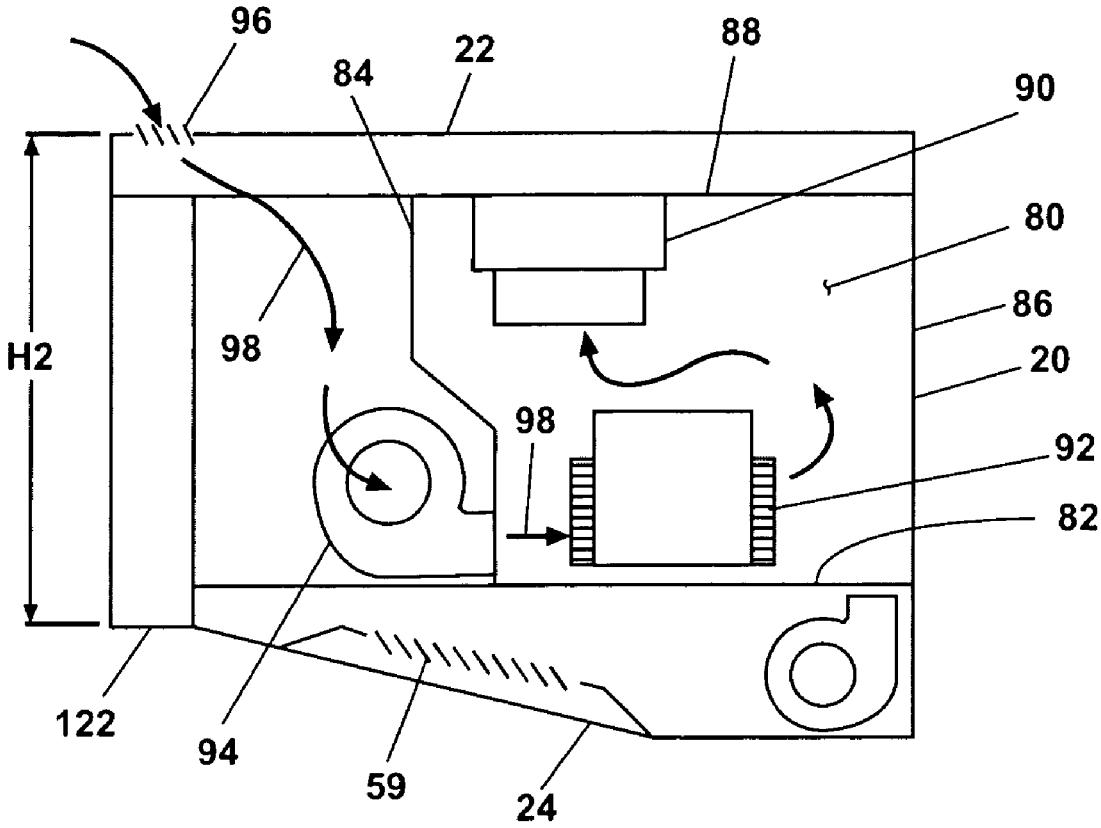
FIG. 4 is a side cross-sectional view of the microwave oven, taken along line IV—IV of FIG. 2.

The first side compartment 72 is configured to contain electrical equipment chamber 80 as shown in FIG. 4. The electrical equipment chamber 80 is defined by a bottom wall 82, a front wall 84 a rear wall 86 and a top wall 88. The side walls 16 and 30 may provide further enclosure walls to complete the electrical equipment chamber 80. Electrical equipment for generating microwave in order to heat food items within the oven cavity 12 are installed in the electrical equipment chamber 80. For example, a magnetron 90 and a high voltage transformer 92 may be provided within the electrical equipment chamber 80 along with other electrical items.

Mounted to the outside of the electrical equipment chamber 80 is a cooling fan or blower 94. The cooling blower 94 is operated to draw air into the first side compartment through a top, inlet vent opening area 96 and direct this cooling air stream 98 into the electrical equipment chamber 80. The cooling air stream 98 may then pass over and around the electrical components provided within the electrical equipment chamber 80 and then pass through the magnetron 90 into the oven cavity 12 or through an air channel 99 above the oven cavity 12.

It can be understood therefore, that when the exhaust blowers 50 and 52 operate, contaminated air flows through the exhaust ventilation system and is vented out into the ambient air through the center vent area 66. Since there is complete isolation of the first side compartment 72 and the electrical equipment chamber 80 from the exhaust ventilation system, the contaminated air stream 58 passing through the exhaust ventilation system does not flow through the electric equipment installation chamber 80. Therefore, the electric equipment such as the magnetron 90 and the high-voltage transformer 92, are not exposed to the contaminated air sucked through the exhaust ventilation system.

Figure 5:
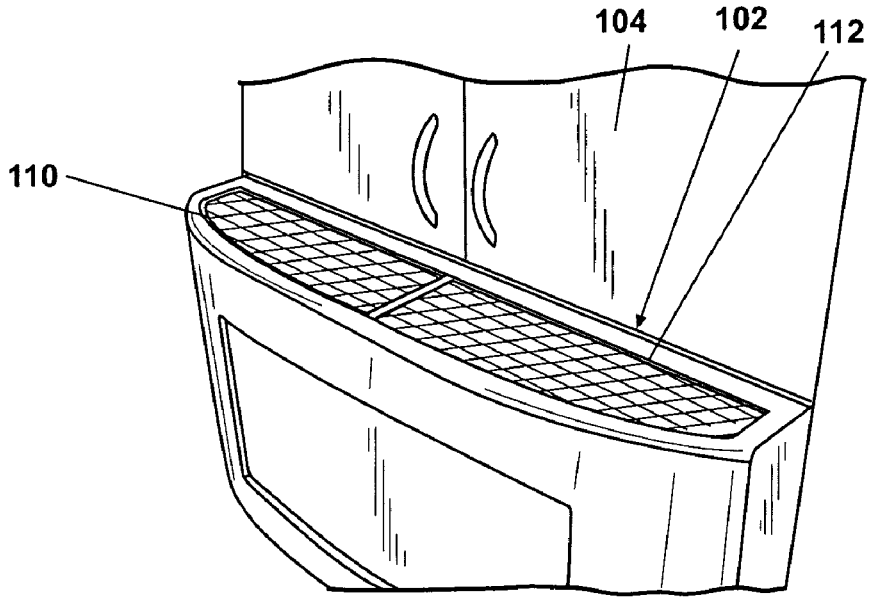
FIG. 5 is a top, front, right perspective view of the microwave oven of the present invention, showing in particular the top vent opening.
Figure 6:
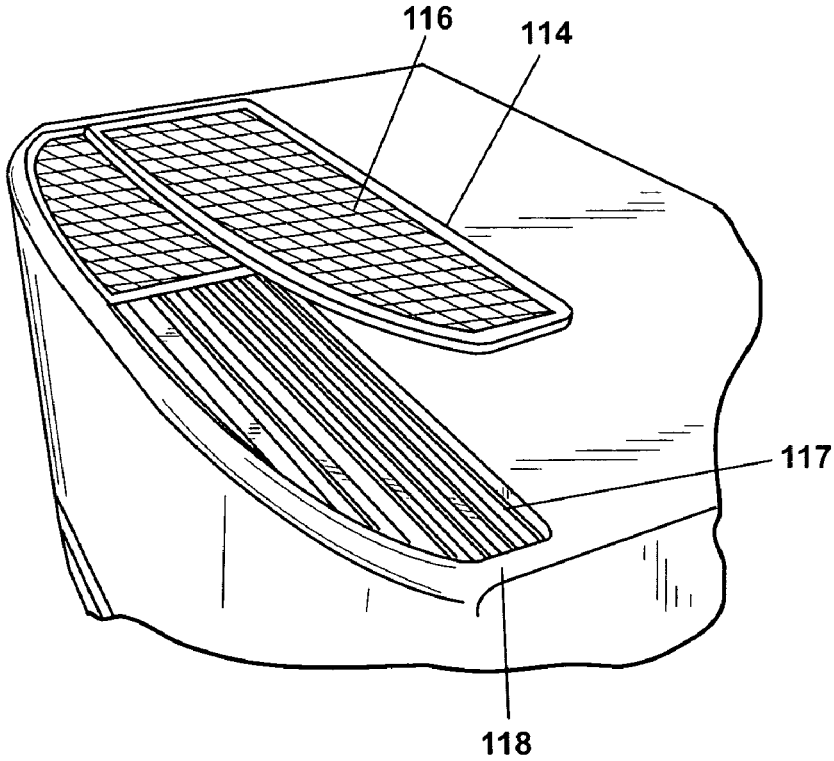
FIG. 6 is a top, front, right perspective view of the microwave oven of the present invention, showing in particular the top vent opening with one of the vent covers exploded from the microwave oven.

Turning now to FIGS. 5 and 6, the top vent opening 102 can be described. The top vent area 102 is the horizontal surface provided along the top, front of the microwave oven which extends outwardly beyond the cabinet structure 104 in which the microwave is commonly mounted. The top vent area 102 includes a center portion forming the top exhaust opening 66, and side portions that that form the top inlet vent opening 96 and an additional top outlet vent opening 106 (FIG. 3), located opposite the inlet opening 96. Air passing through the air channel 99 may exit the microwave through the outlet vent opening 106. As discussed above, after the air stream 58 passes through the exhaust ventilation system and vents upwardly into the ambient environment through the top exhaust opening 66. The side vent opening area 96 is an air inlet for the electrical equipment cooling system. As noted above, the other side vent opening area 106 may be used as an exhaust for the cooling air stream 98 but may also supply air to a forced air heating system (not shown) which may be mounted in the second side compartment 74.

It can be understood that it is desirable to minimize the overall height of the enclosure (H2) while at the same time providing a desired or required internal height within the oven cavity (H1). In particular, it is desirable to accommodate the desired cavity height (H1) without having the bottom closure wall 24 and a lower front edge 122 of the bottom closure wall too close to the cooktop which may be provided below the microwave oven 10. By providing a sufficient space between the lower front edge 122 and the cooktop, visibility of the cooktop is enhanced and the bottom closure wall 24 does not become too warm. The configuration of the present invention is designed to provide the desired visibility and space between the lower front edge 122 and the cook-top. By locating the top vent area 102 along the top surface provided of the microwave oven and by providing a bottom closure wall 24 which extends upwardly from the bend line 56 it is possible to minimized the overall height H2 and provide the benefits discussed above.

Provided along the top vent area 102 are a pair of vent filter covers 110 and 112. These vent filter covers are preferably constructed of a plastic frame 114 which supports a filter mesh interior 116. The vent filter covers 110 and 112 are removably fitted within a depressed region 117 provided about the top vent area 102 such that the vent filter covers are positioned below a top surface 118 of the microwave oven when they are properly installed. The top surface 118 may be formed as part of the top wall 22. The vent filter covers 110 and 112 are readily removed for cleaning.

The vent filter covers are designed to provide a final filter for exhausted air passing through the exhaust ventilation system and also to prevent foreign objects from passing into the upper air plenum 64 and the first and second side compartments 72 and 74. Beneath the vent filter covers 110 and 112 are louvers 120 which direct the air flow outwardly and also support the vent filter covers 110 and 112.

Accordingly, it can be understood that the present invention provides a microwave that achieves a maximization of space within the oven cavity 12. This is achieved through use of a unique exhaust ventilation system having an air exhaust path which flows air through a pair of rear air channels which are divided by the rearwardly stepped portion 44 of the oven cavity 12. In this way, the oven cavity may be sized sufficiently large to accommodate a large turn table plate 42—which may be as large as 40 centimeters to accommodate large items. Additionally, since the air exhaust path does not occupy any space along the sides the oven cavity 12, a maximum cavity width is feasible. The oven cavity width is only limited within the enclosure by the first and second side components which may be configured to contain an electrical equipment chamber 80.

It can be understood, moreover, that by locating the top vent opening along the horizontal top, front surface of the microwave oven and having the bottom closure wall slope upwardly from a bend line the desired oven cavity height may be accommodated while minimising the overall height of the microwave oven. Moreover, the attractiveness of the microwave is enhanced by locating all of the vent openings on surfaces other than the front surface which formed primarily by the pivotable door 26.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A wall mounted type microwave oven comprising:

an external enclosure having a bottom closure wall which includes a suction opening and a top vent opening, the enclosure further having a side wall;

an oven cavity supported within the external enclosure, the oven cavity having a rearwardly stepped portion to maximize the usable space provided within the oven cavity, the oven cavity having a side wall;

an air exhaust path formed between the external enclosure and the oven cavity, the air exhaust path including a bottom plenum, a pair of rear air channels and an upper plenum;

at least one blower provided within the external enclosure for drawing air into the bottom plenum through the suction opening and exhausting the air out through a top exhaust opening which forms part of the top vent opening;

wherein the rearwardly stepped area divides the space between the oven cavity and the external enclosure into the two rear air channels which receive an exhaust air scream from the blower.

2. The wall mounted type microwave oven according to claim 1, wherein the top vent opening is provided along a horizontal top, front surface of the microwave oven and includes a center portion forming the top exhaust opening, and side portions that that form top vent inlet openings.

3. The wall mounted type microwave oven according to claim 2, further comprising:

at least one filter cover provided over top vent opening, the filter cover having a frame supporting a filter mesh interior.

4. The wall mounted type microwave oven according to claim 3, further wherein the at least one filter cover is removably fitted within a depressed region provided about the top vent area such that the filter cover is positioned below a top surface of the enclosure.

5. The wall mounted type microwave oven according to claim 3, further a plurality of louvers are provide across the top vent opening below the filter cover for supporting the filter cover and directing air flow.

6. The wall mounted type microwave oven according to claim 1, further comprising:

a side compartment formed between the side wall of the external enclosure and the side wall of the oven cavity, the side compartment being isolated from the air exhaust path such that the exhaust air stream does not communicate with the side compartment;

an electrical equipment chamber set within the side compartment;

a cooling blower mounted within the side compartment for drawing air into the side compartment through the top inlet opening which forms part of the top vent opening.

7. The wall mounted type microwave oven according to claim 1, further wherein the air exhaust path is provided along the bottom plenum, the pair of rear air channels and the upper plenum and does not occupy any space along the sides the oven cavity so that a maximum oven cavity width is achieved.

8. The wall mounted type microwave oven according to claim 1, further comprising:

a first side compartment formed between the side wall of the external enclosure and the side wall of the oven cavity;

a second side compartment formed between an opposite side wall of the external enclosure and an opposite side wall of the oven cavity such that the first and second side compartments are positioned on opposite sides of the oven cavity;

a center compartment including the bottom plenum, rear air channels and the upper plenum, wherein the first and second side compartments are sealed off from the air exhaust path.

9. The wall mounted type microwave oven according to claim 1, wherein the oven cavity includes a front opening, the microwave oven further comprising:

a door pivotably adjacent the front opening, the door forming a front surface of the microwave, and wherein the bottom closure wall slopes upwardly from a bend line and the top vent opening is provided along a horizontal top, front surface of the microwave oven such that the desired oven cavity height may be accommodated while minimising the overall height of the microwave.

10. The wall mounted type microwave oven according to claim 1 wherein the bottom plenum has an enlarged rear portion and the bottom closure wall slopes upwardly from a bend line toward the front of the microwave, and the at least one blower is located in the enlarged rear portion of the bottom plenum.

11. A wall mounted type microwave oven comprising:

an external enclosure having a bottom closure wall which includes a suction opening and a top vent opening, the enclosure further having a side wall;

an oven cavity supported within the external enclosure, the oven cavity having a rearwardly stepped portion to maximize the usable space provided within the oven cavity, the oven cavity having a side wall;

an air exhaust path formed between the external enclosure and the oven cavity, the air exhaust path including a bottom plenum, at least one rear air channel and an upper plenum;

at least one blower provided within the external enclosure for drawing air into the bottom plenum through the suction opening and exhausting the air out through a top exhaust opening which forms part of the top vent opening;

wherein the rearwardly stepped area divides the space between the oven cavity and the external enclosure into the at least one air channel which receive an exhaust air stream from the blower and the bottom closure wall slopes upwardly from a bend line and the top vent opening is provided along a horizontal top, front surface of the microwave oven such that the desired oven cavity height may be accommodated while minimizing the overall height of the microwave oven and the at least one air channel comprises a pair of rear air channels.

12. The wall mounted type microwave oven according to claim 11, further comprising:

at least one filter cover provided over top vent opening, the filter cover having a frame supporting a filter mash interior.

13. The wall mounted type microwave oven according to claim 11, further comprising:

a side compartment formed between the side wall of the external enclosure and the side wall of the oven cavity, the side compartment being isolated from the air exhaust path such that the exhaust air stream does not communicate with the side compartment;

an electrical equipment chamber set within the side compartment;

a cooling blower mounted within the side compartment for drawing air into the side compartment through the top inlet opening which forms part of the top vent opening.

14. The wall mounted type microwave oven according to claim 13, further wherein the air exhaust path is provided along the bottom plenum, a pair of rear air channels and the upper plenum and does not occupy any space along the sides the oven cavity so that a maximum oven cavity width is achieved.

* * * * *